US009668933B1

(12) United States Patent
Johnson

(10) Patent No.: US 9,668,933 B1
(45) Date of Patent: Jun. 6, 2017

(54) EXERCISE AND MASSAGE ROLLER

(76) Inventor: Ronald B. Johnson, Casa Grande, AZ (US)

( * ) Notice: Subject to any disclaimer, the term of this patent is extended or adjusted under 35 U.S.C. 154(b) by 1109 days.

(21) Appl. No.: 12/802,551

(22) Filed: Jun. 8, 2010

(51) Int. Cl.
*A61H 15/00* (2006.01)

(52) U.S. Cl.
CPC ..... *A61H 15/00* (2013.01)

(58) Field of Classification Search
USPC ..... 601/112, 118, 119–123, 125, 126, 127, 601/134–137; D24/200, 211–215
See application file for complete search history.

(56) References Cited

U.S. PATENT DOCUMENTS

| | | | | | |
|---|---|---|---|---|---|
| 655,490 | A | * | 8/1900 | Hollem | 601/135 |
| 1,726,560 | A | * | 9/1929 | Hassler | 601/136 |
| 1,811,764 | A | | 6/1931 | Sherwood | |
| 2,273,710 | A | * | 2/1942 | Klaes | 601/119 |
| 2,286,324 | A | | 6/1942 | Wentz | |
| 3,548,814 | A | * | 12/1970 | Montgomery et al. | 601/118 |
| 3,672,356 | A | * | 6/1972 | Possick | 601/120 |
| 4,210,135 | A | | 7/1980 | Deuser | |
| D256,841 | S | | 9/1980 | Corbett et al. | |
| 4,345,387 | A | * | 8/1982 | Daswick | 36/43 |
| 4,378,007 | A | | 3/1983 | Kachadourian | |
| D285,117 | S | | 8/1986 | Snyder | |
| 4,846,159 | A | | 7/1989 | Anzai | |
| 4,907,355 | A | * | 3/1990 | Allen et al. | 36/131 |
| 4,945,900 | A | | 8/1990 | Masuda | |
| D345,610 | S | | 3/1994 | Shih | |
| D357,952 | S | | 5/1995 | Chen | |
| 5,735,804 | A | * | 4/1998 | Chan | 601/136 |
| 5,824,013 | A | * | 10/1998 | Allen | 606/240 |
| 5,947,666 | A | | 9/1999 | Huang | |
| D471,636 | S | * | 3/2003 | Yu | D24/212 |
| 6,764,456 | B1 | * | 7/2004 | Doherty | 601/121 |
| 7,007,978 | B1 | | 3/2006 | Purdom | |
| 7,108,646 | B1 | * | 9/2006 | Quick | 482/148 |
| 7,918,774 | B2 | * | 4/2011 | Dye | 482/132 |
| 2002/0103415 | A1 | | 8/2002 | Manska | |
| 2005/0033205 | A1 | | 2/2005 | Komkin | |
| 2005/0049532 | A1 | | 3/2005 | Lee | |
| 2005/0131320 | A1 | * | 6/2005 | Lee | 601/119 |
| 2007/0072952 | A1 | * | 3/2007 | Kusakawa et al. | 521/134 |
| 2007/0086612 | A1 | * | 4/2007 | Nishibori et al. | 381/333 |
| 2007/0129654 | A1 | * | 6/2007 | Anderson | 601/119 |

(Continued)

OTHER PUBLICATIONS

Muscleroll—Biowellnesssolutions.com—2008.
Power Systems 2009 Product Catalog—p. 73.

*Primary Examiner* — Justine Yu
*Assistant Examiner* — Kathrynn Lyddane
(74) *Attorney, Agent, or Firm* — Booth Udall Fuller, PLC

(57) ABSTRACT

A roller which an individual may use to perform a variety of self-applied exercises for massage, myofascial release and other exercises. The roller is cylindrical having a resilient outer surface on which are a plurality of axially spaced, circumferentially extending bands of similar projections which manipulate the body of the individual when the individual rolls against the surface of the roller. The projections are equally circumferentially spaced in each band extending around the cylindrical body. The material and shape of the projections are selected to provide greater resistance to bending or flexing to forces applied axially than to tangentially applied forces.

15 Claims, 18 Drawing Sheets

(56) References Cited

U.S. PATENT DOCUMENTS

| | | | | |
|---|---|---|---|---|
| 2008/0090707 | A1* | 4/2008 | Dye | 482/132 |
| 2008/0103421 | A1 | 5/2008 | Nicholson | |
| 2008/0244932 | A1* | 10/2008 | Nau | 36/102 |
| 2009/0112137 | A1 | 4/2009 | Lamore | |
| 2011/0245741 | A1 | 10/2011 | L'Homme | |
| 2011/0313333 | A1 | 12/2011 | Nicholson | |
| 2012/0065557 | A1* | 3/2012 | Phillips | 601/99 |

* cited by examiner (UPPER BACK)

(CALF)

EXERCISE AND MASSAGE ROLLER

FIELD OF THE INVENTION

The present invention relates to an exercise and massage apparatus and more particularly relates to a roller which an individual may use to perform a wide variety of self-applied exercises for massage, myofascial release and other healthful benefits.

BACKGROUND OF THE INVENTION

Many athletes, trainers, therapists and others involved in fitness and training endorse the use of various types of massage devices and techniques to achieve myofascial relief, as well as other benefits. These benefits include improved balance, posture, reduction of chronic pain, improved flexibility, enhanced range of motion, as well as general well-being and alleviation of stress.

Fascia is a type of dense, connective tissue which surrounds muscles, bones, joints and other parts of the body. This tissue can become inflamed, thick, tough and knotted causing pain in areas termed "trigger points." Many therapists and trainers recommend the use of myofascial release massage to treat these trigger point areas, including self-applied massage exercises.

Traditionally there are various self-applied exercises that an individual can perform which do not require the presence or assistance of an attendant or masseuse. These exercises often involve the use of some type of device such as a simple roller. Rollers used for self-myofascial release and massage therapy will also help develop balance and alignment. These rollers are generally resilient rollers of materials such as rubber or heat-sealed EVA foams and are available in different lengths, diameters and surface textures. Conventional foam rollers will, to some extent, compress soft tissue. Using these rollers in various fashions, such as performing simple exercises in which the individual rolls the roller against a part of the user's body may improve blood flow and tissue flexibility. However, the effect is often limited and relatively superficial and these type rollers do not provide the deeper and thorough massage effect necessary to achieve effective myofascial release.

BRIEF SUMMARY OF THE INVENTION

Briefly, the present invention provides a self-massage and myofascial release roller which has an elongated cylindrical body which may be solid or may have a hollow core. The exterior surface of the roller is a natural or synthetic resilient material. Arranged on the exterior surface of the roller body and integrally formed therewith, are a plurality of axially spaced-apart, circumferentially extending bands of similarly shaped massage projections. The individual projections are equally circumferentially spaced in the band extending around the cylindrical body of the roller. The individual projections in the spaced-apart bands may be axially aligned or the bands may be alternately offset so the projections in alternate rows are axially aligned.

In an embodiment, each of the projections has a radial cross-section having a generally arcuate apex with opposite sidewalls and end walls diverging downwardly to transition into the cylindrical body. The projections each have an axial cross-section extending through the apex which is generally rectilinear. The projections are a material selected to provide greater resistance to bending or flexing to forces axially applied than to tangentially applied forces to provide selective massage effects with a variety of self-applied exercises.

In other embodiments, the massage projections may be variously configured to produce the desired resistance characteristics upon contact, pressure and direction of applied force.

The surface of the roller body and projections are smooth, non-porous to repel dirt and to facilitate cleaning. The material of the roller body and projections may also be formulated to include suitable antibacterial and antifungal compounds.

BRIEF DESCRIPTION OF THE DRAWINGS

The above and other advantages and objects of the present invention will become more apparent from the following description, claims and drawings in which:

DETAILED DESCRIPTION OF THE DRAWINGS

Turning now to the drawings, particularly FIGS. 1 through 7, a massage therapy and exercise roller according to the present is shown as generally designated by the numeral 10.

Figure 3:
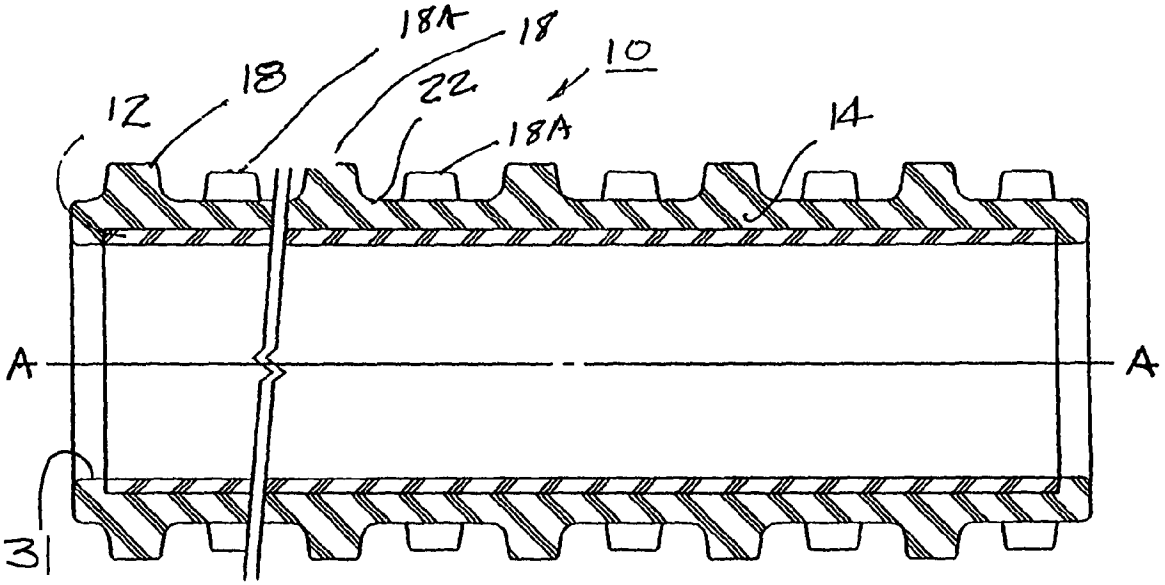
FIG. 3 is a longitudinal section view taken along line 3-3 of FIG. 2.
Figure 2:
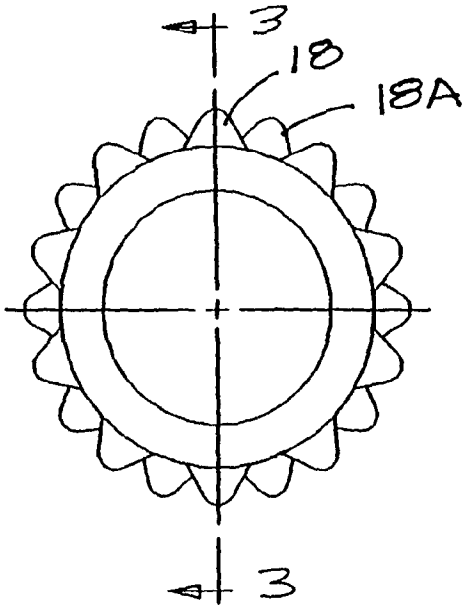
FIG. 2 is an end view thereof.
Figure 4:
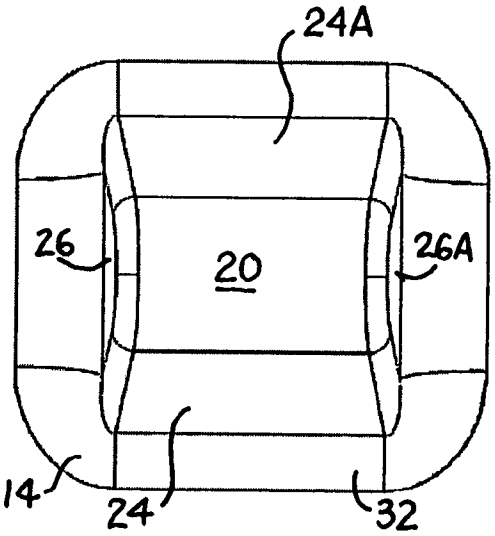
FIG. 4 is a top view of one of the projections on the surface of the roller shown in FIG. 1.
Figure 6:
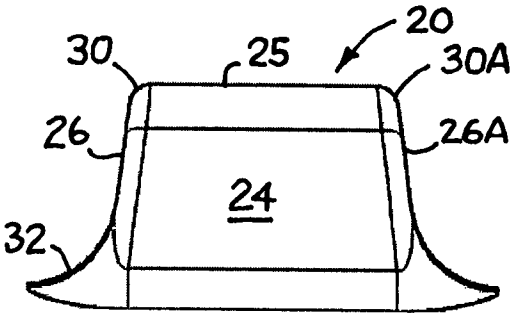
FIG. 6 is a side view of the projections, the opposite side view being the same.
Figure 5:
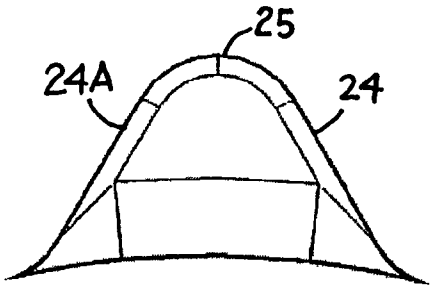
FIG. 5 is an end view of one of the projections, the opposite end being the same.

The roller 10 according to the present invention has a cylindrical core 12 which may be a suitable elastomeric material, rigid plastic, metal or wood. The roller core may be either solid or have a hollow construction, as shown in FIG. 3. A cylindrical exterior body 14 comprising two opposing lips 31 extends about the core. The body 14 is preferably molded from an elastomeric material such as natural or synthetic rubber which will provide the required stiffness, compressability, cleanability and surface texture. Exemplary materials are Neoprene®, Buna-N, silicone, polyurethane, EPDM, SBR, vinyl, butyl or synthetic foams such as polyethylene, EVA and polyolefins. A preferred material is a blend of EVA and a polyolefin with a solid EVA core both having a durometer hardness of between 30 to 50 Asker C. The size of the roller 10 may vary, but typically for most applications is approximately 4" to 6" in diameter and 12" to 36" in length.

Figure 1:
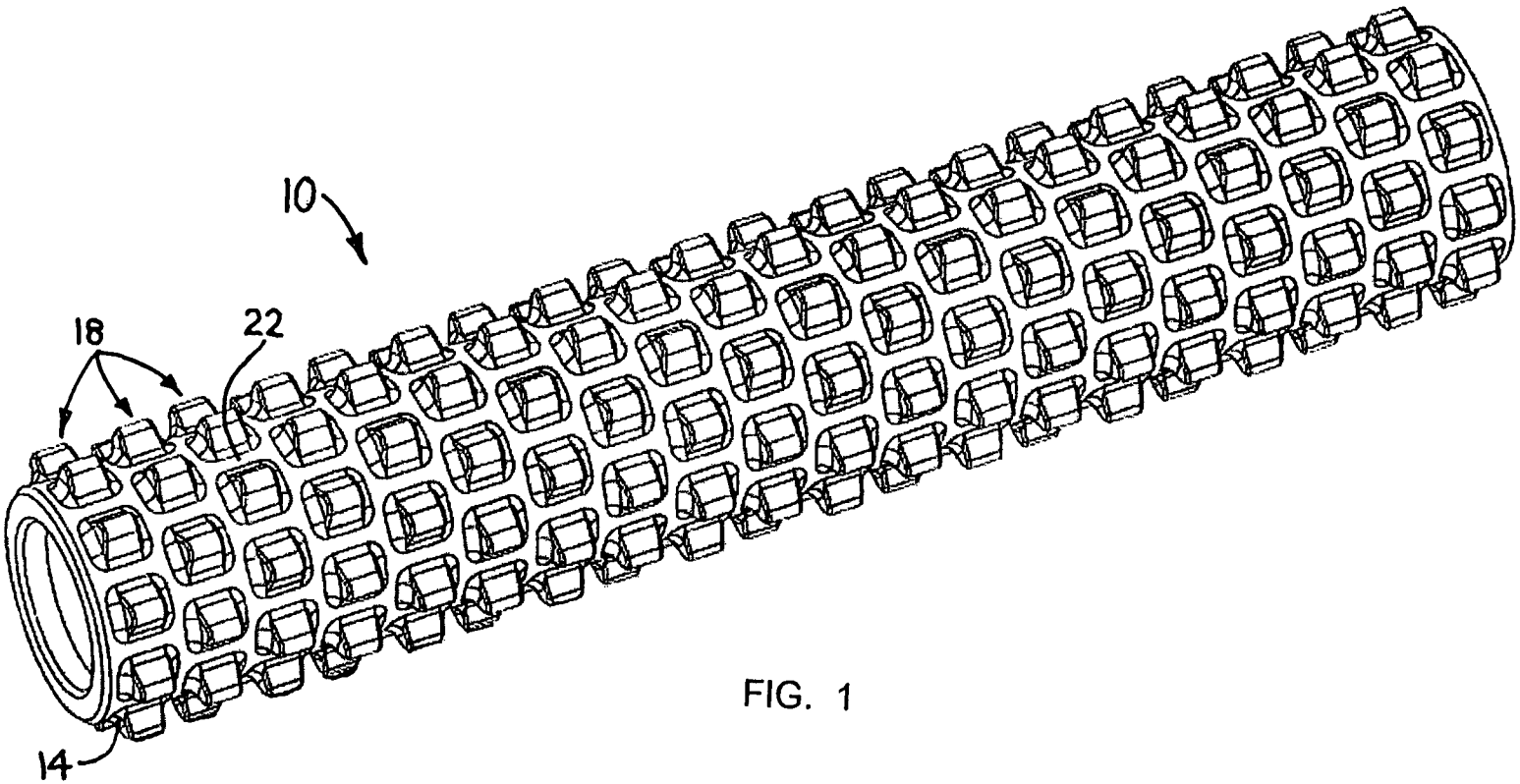
FIG. 1 is a perspective view of an embodiment of the exercise and massage roller of the present invention.

Integrally formed along the exterior surface of the body 14 are a plurality of axially spaced-apart, circumferential bands 18 of massage projections 20. The projections are similar in shape and are equally circumferentially spaced apart in each circular band 18. The circular bands of projections may be formed with the projections 20 axially aligned, or alternate bands may be staggered as shown in FIG. 1. Bands 18 are aligned and bands 18A are aligned with one another. In the staggered positions, the projections 20 in alternate rows are aligned and are also aligned with the intermediate space 22 existing between projections 20 in the adjacent rows. The particular orientation of the roller projections selected will be dependent upon personal preference, the exercises to be performed, as well as more subjective considerations such as tactile feel and comfort to the individual user.

The details of the individual projections are best seen in FIGS. 4 to 7. Each projection 20 has opposite sidewalls 24, 24A which converge upwardly at an angle of approximately 15° to a generously radiused arcuate apex 25. The opposite end walls 26 and 6A diverge downwardly at an angle of approximately 60°. A slight radius extends along the upper edges 30, 30A of end walls 26 and 26A where the end walls transition into the sidewalls and also to the apex 25. The bottom edges of the integral sidewalls and end walls smoothly transition into the roller body 14 at radiused peripheral edge 32 extending around the base 29 of each projection.

Figure 7:
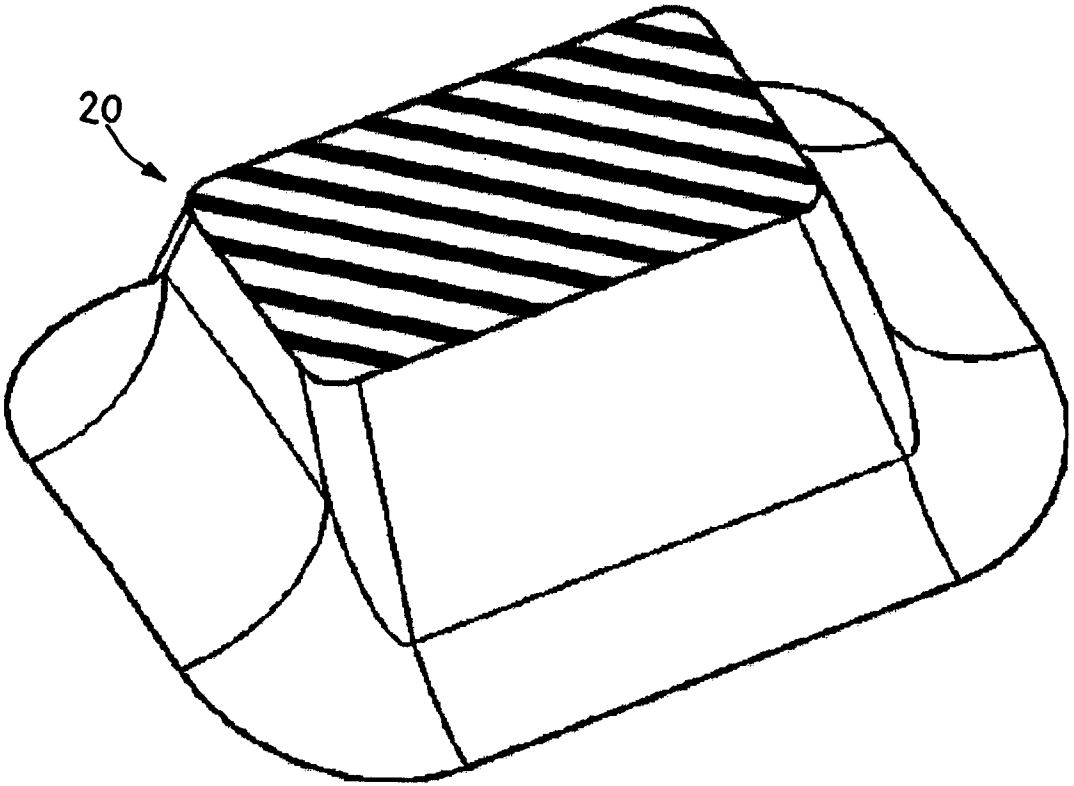
FIG. 7 is a perspective view of a representative projection on the roller partly cut-away.

The particular dimensions of the individual projections may vary, but it is preferred that the individual projections are each about ½" high, ¾" to 1½" in axial length and ½" to 1¼" wide at their bases. The shape and configuration of the projections is critical to achieving the self-massage benefits of the present invention. Contact with an external body, such as the body of a person performing exercises and other routines on the roller 10, results in application of forces tangential to the projections in both radial and axial directions. As a result, a bending movement is applied about the projections relative to their attachment at their bases to the cylindrical body 14. Because the projections 20 are non-circular in cross-section, as seen in FIG. 7, reaction to applied forces vary depending on the direction in which the force is applied.

In general, the initial and subsequent contact areas which are applied to the projections are related to the shape of the projections as the roller is rolled against the body of the user. The material and geometry of the projections affects the area of the contact, the size of the contact area under compressive load and the amount of bending of the projection.

An important functional feature is the configuration of the projections which are designed to respond differently to loads applied by the user's body in different directions to achieve the massage effect. Tangential application of force or load occurs when the overall motion of the body of the user is generally tangential to the roller 10 in a direction perpendicular to the roller axis A-A causing the roller to roll beneath the user. When a load or force is applied in an axial direction, the overall motion of the user is generally parallel to the axis A-A of the roller. Various representative exercises in which both tangential and axial application of loads are described below with reference to FIGS. 14 to 17.

Figure 8:
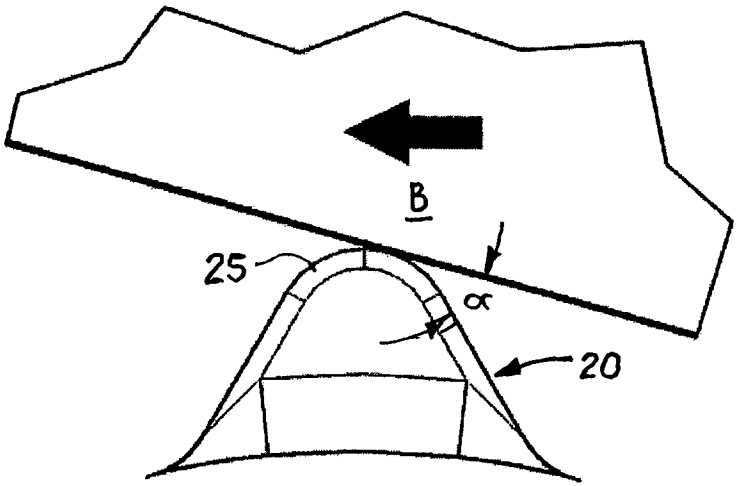
FIG. 8 is an end view of one of the projections, as seen in FIG. 1, shown with the application of a tangential load.

FIG. 8 shows the application of a tangential load to a projection 20 by the body of the user. The body of the user is represented by the letter "B" and a tangential force applied is indicated by the direction of the arrow which is tangential to the projections 20. The apices of the projections are fully radiused at 25 so the angle of contact (alpha) between the surface of the projection and the external body B remains tangential as the applied force engages a projection and then advances to the next projection as rotation of the roller occurs.

Figure 9:
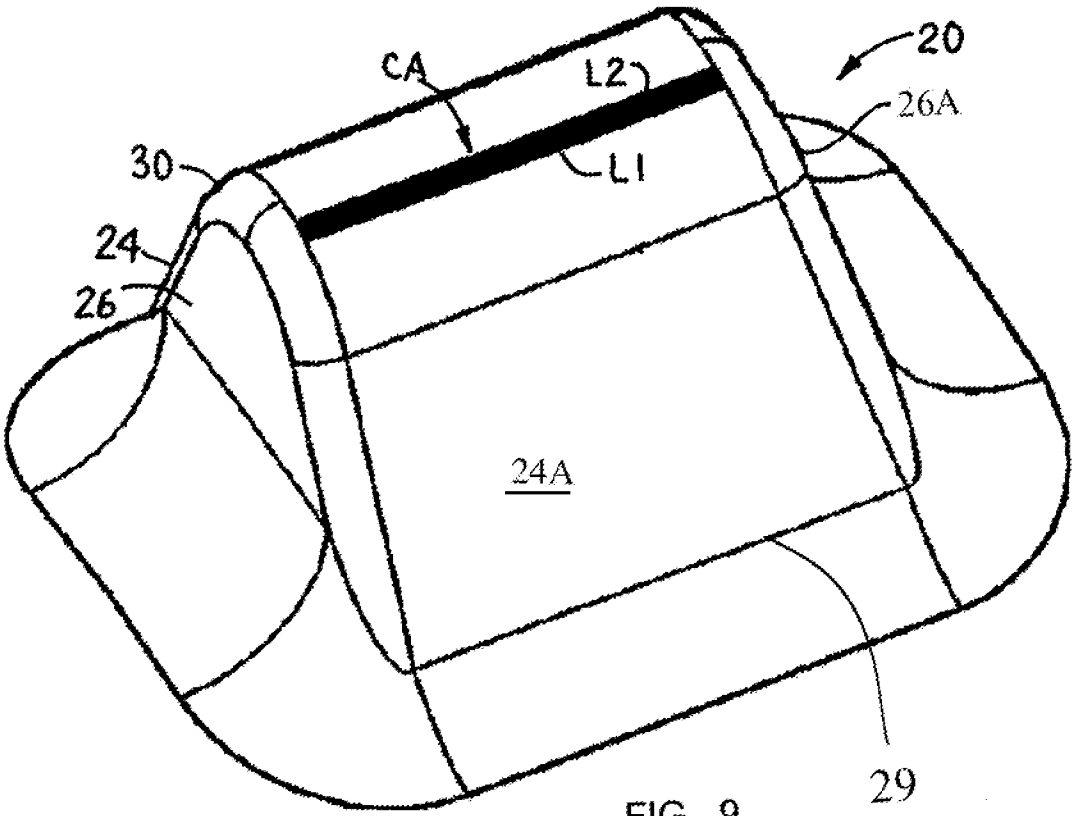
FIG. 9 is a perspective view showing the contact area as an initial tangential load is applied to a projection, as shown in FIG. 8.
Figure 10:
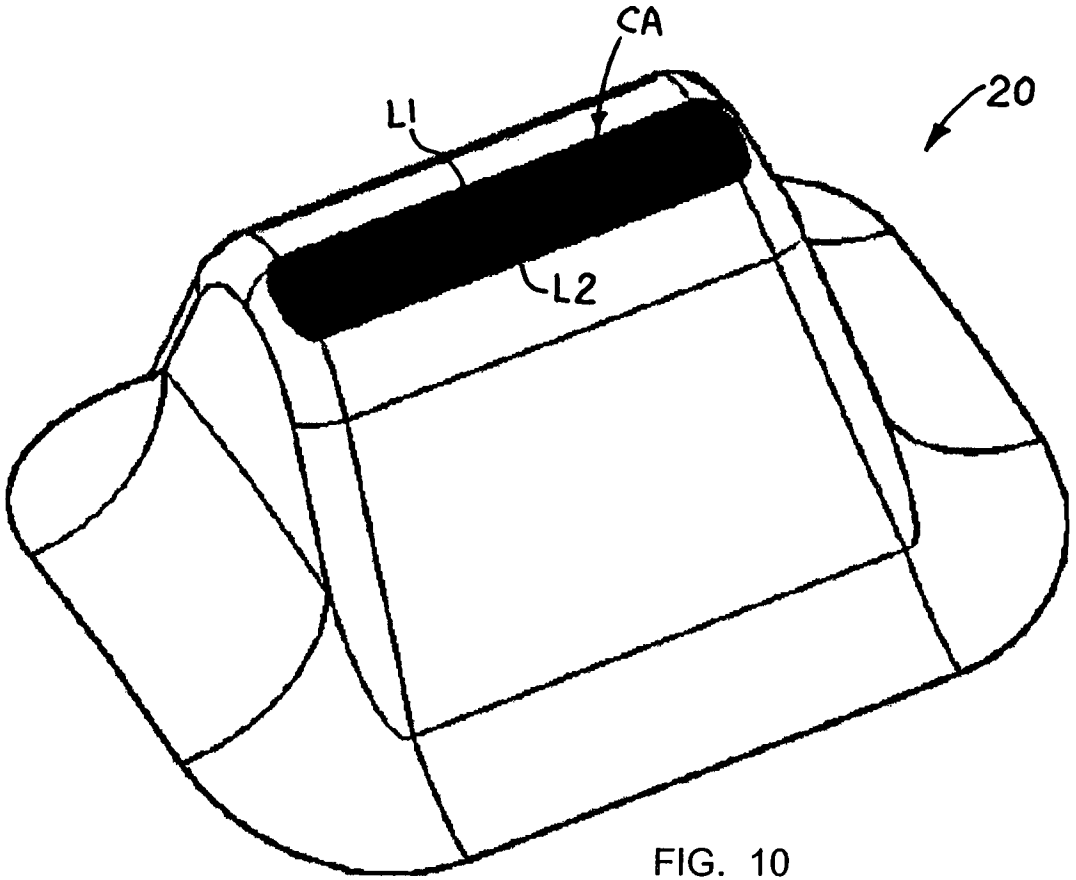
FIG. 10 is a perspective view similar to FIG. 9 showing increased contact area as the load applied to a projection is increased.

Referring to FIG. 9, the initial contact area CA when tangential forces are applied is bordered by two axial lines $L_1$, $L_2$, each extending the length of the projection. As the user's body B moves in the direction of the arrow, as seen in FIG. 8, the roller will roll and the contact area CA will enlarge as seen in FIG. 10.

As motion continues, the contact area CA between the user's body and the projection will gradually decrease and finally dissipate as the roller 10 continues to rotate and the body B moves to engage successive projections in the circular band.

The projection 20 responds in the manner of a cantilever beam. The deflection is proportionate to the beam's moment of inertia which is dependent on its cross-sectional shape. The cross-sectional shape of the projection is generally rectangular and the corresponding moment of inertia and resulting deflection is therefore proportionate to the width of the cross-sectional area times the cube of the height of the cross-sectional area.

The side walls 24, 24A of the projections have a more pronounced upwardly extending inward slope than the end walls 26, 26A. As a result, the angle of incidence between the plan of the contacting body B and the projection surface is less than it is when a load is applied in the axial direction.

Figure 11:
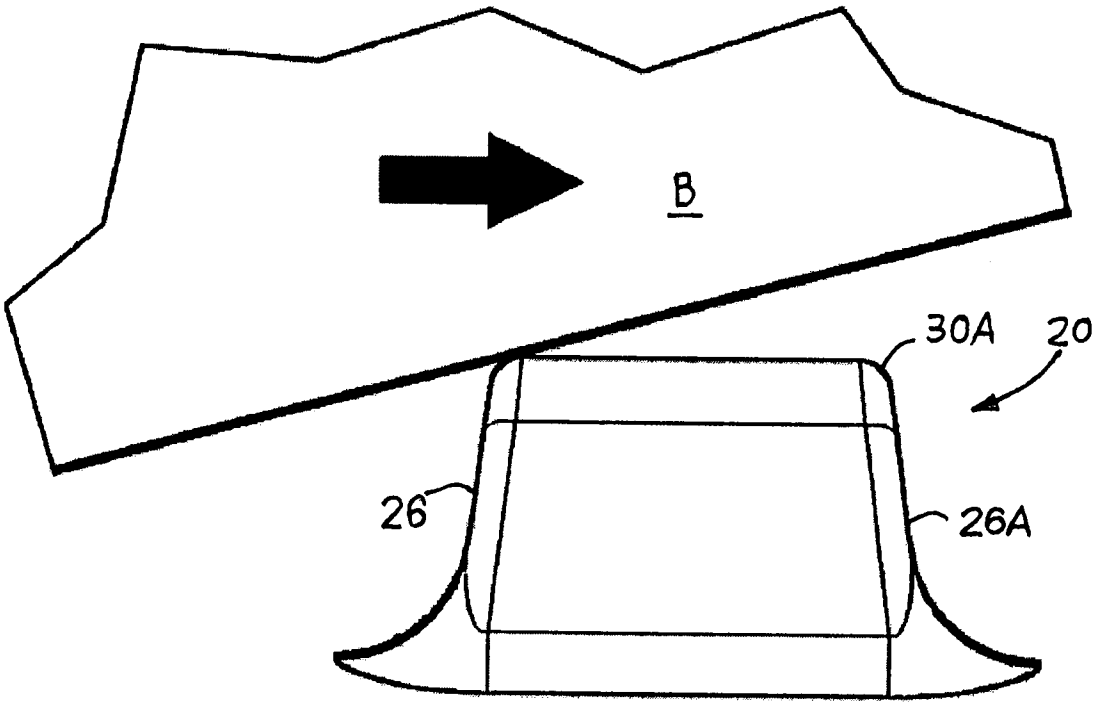
FIG. 11 is a side view of one of the projections, as seen in FIG. 1, showing an axial load being applied to the upper edge of a projection as would occur when some exercises are performed.
Figure 12:
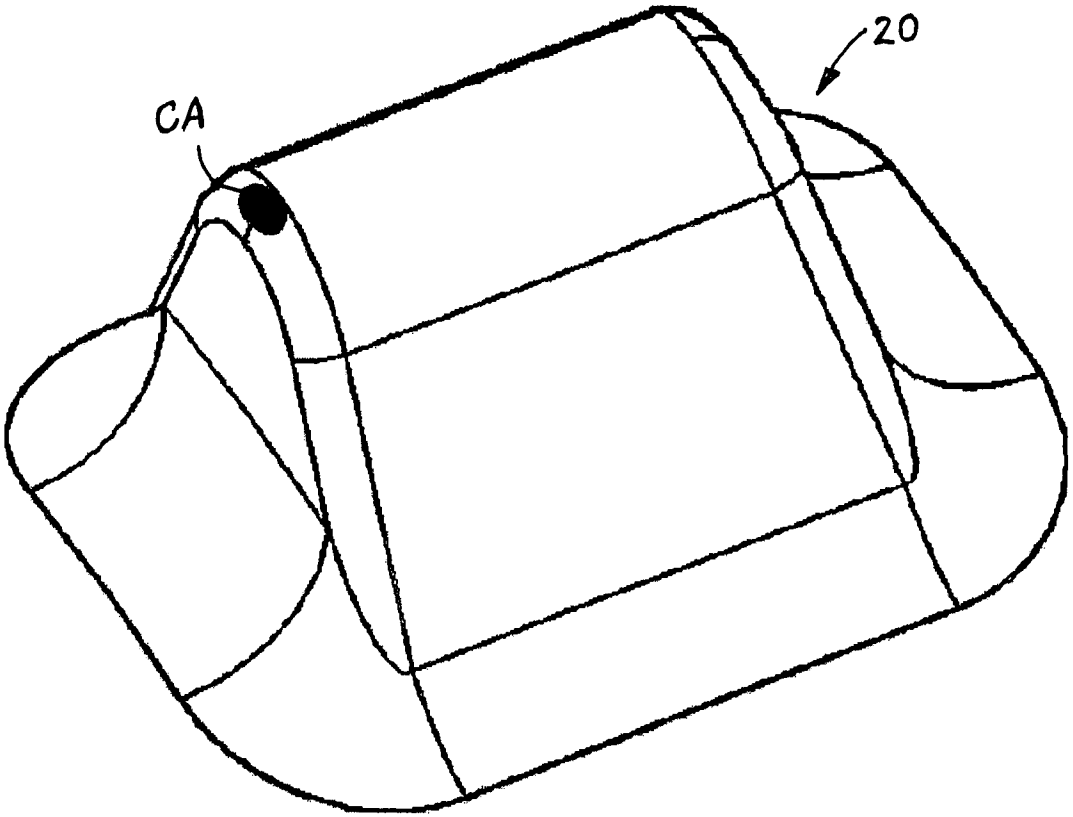
FIG. 12 is a perspective view showing the area of contact as an axial load is initially applied to a projection, as seen in FIG. 11.
Figure 13:
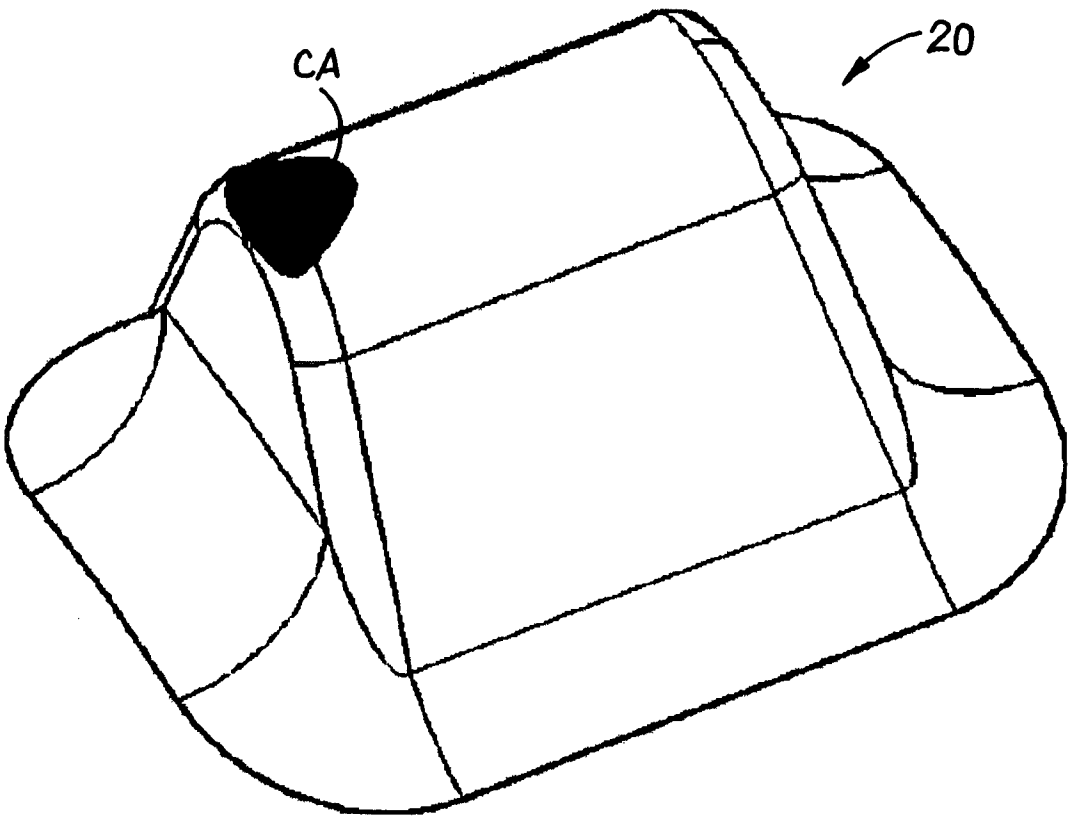
FIG. 13 is a perspective view of a projection showing the increased area of contact as a load is continued to be applied, as shown in FIG. 11.

Reference is now made to FIGS. 11 to 13 which show the response of a projection 20 to loads in the axial direction, applied during an exercise routine. Note the upper ends of the opposite end walls 26, 26A, each have a relatively small radii 30, 30A at their upper ends that transitions into the apex 25 and the sidewall areas. The initial contact with the plane of the body B is point contact, as seen in FIG. 12 represented by the area CA. This area enlarges to a generally circular contact area, as seen in FIG. 13, as the applied load increases and moves in a tangential direction with the resistance to flex being greater than with radial loads and higher contact pressure simulating deep application of massage by use of the thumbs and fingers.

FIGS. 11, 12 and 13 show the reaction to axial loads applied to a single projection. It will be appreciated that in normal use, multiple bands of projections will be engaged and then relieved of loads as the roller rotates against and moves along the body of the user, which is illustrated in FIG. 11.

Figure 14:
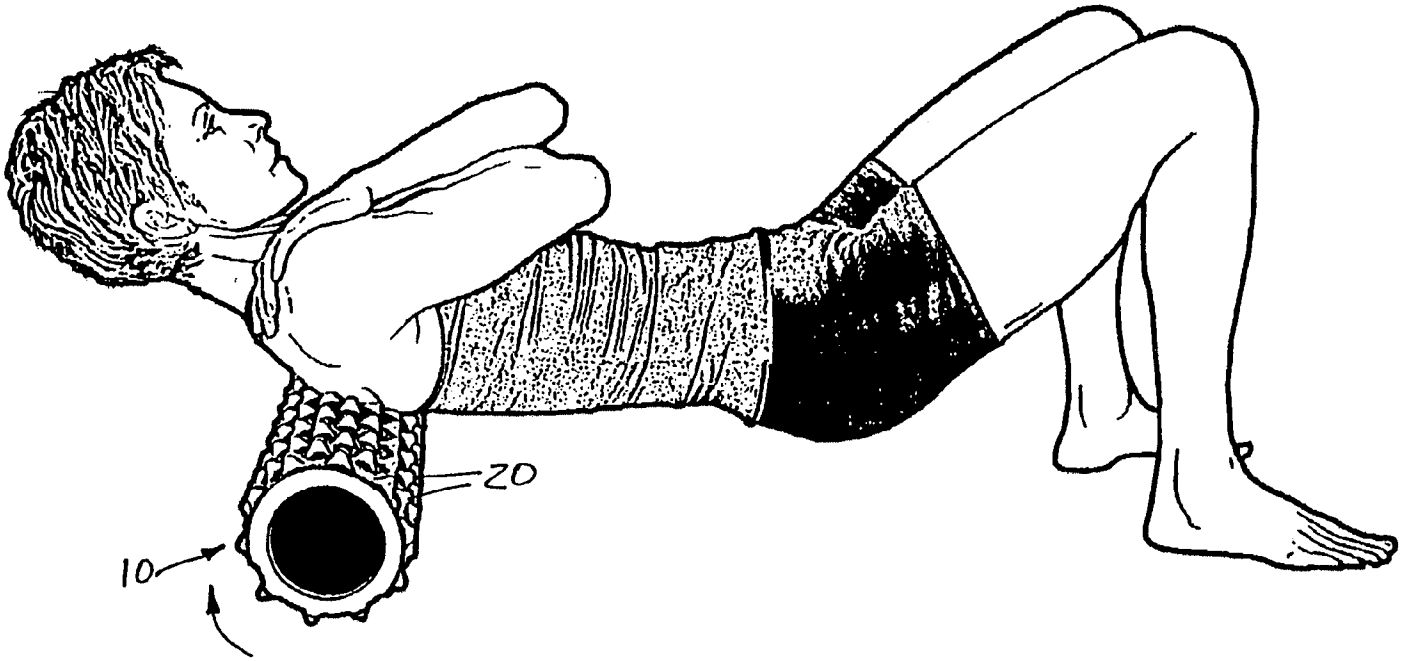
FIGS. 14 to 17 show various representative exercises that may be performed using the roller of the present invention.
Figure 15:
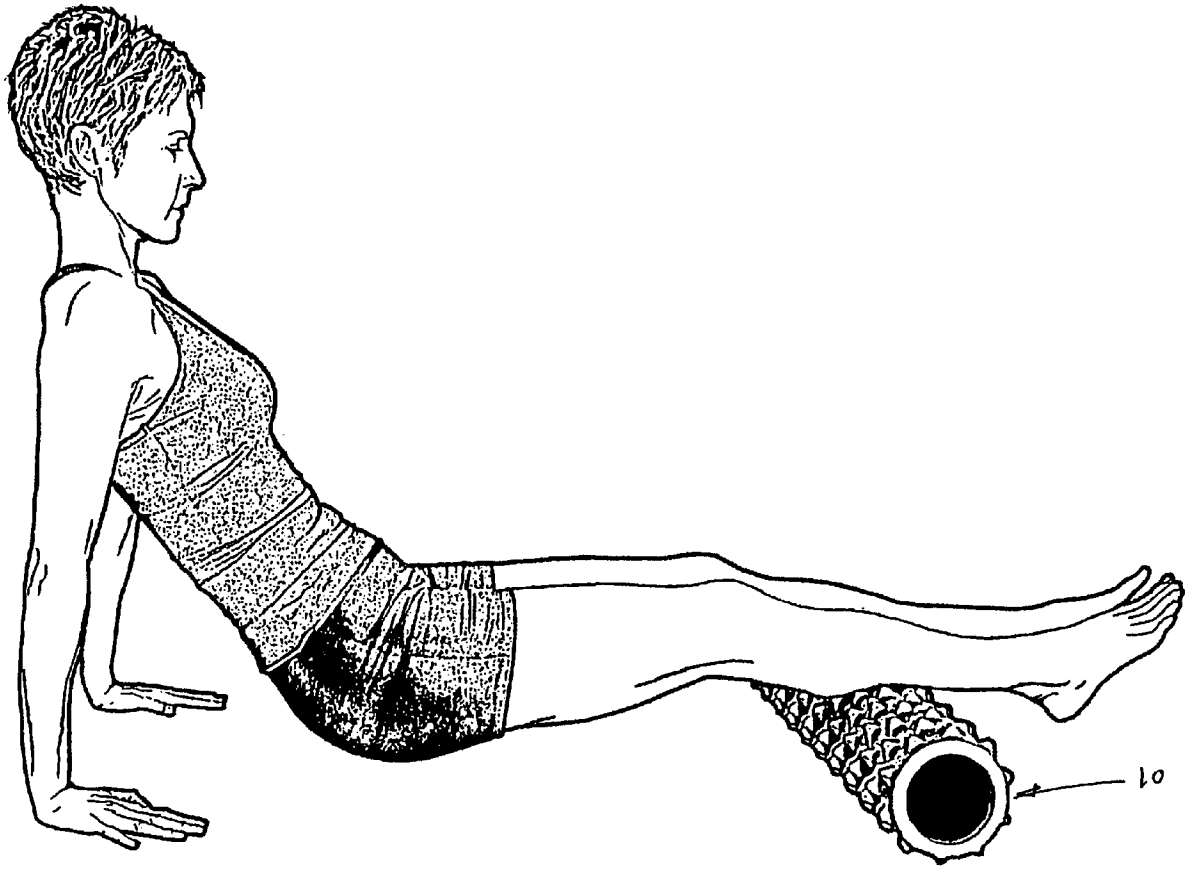
Figure 16:
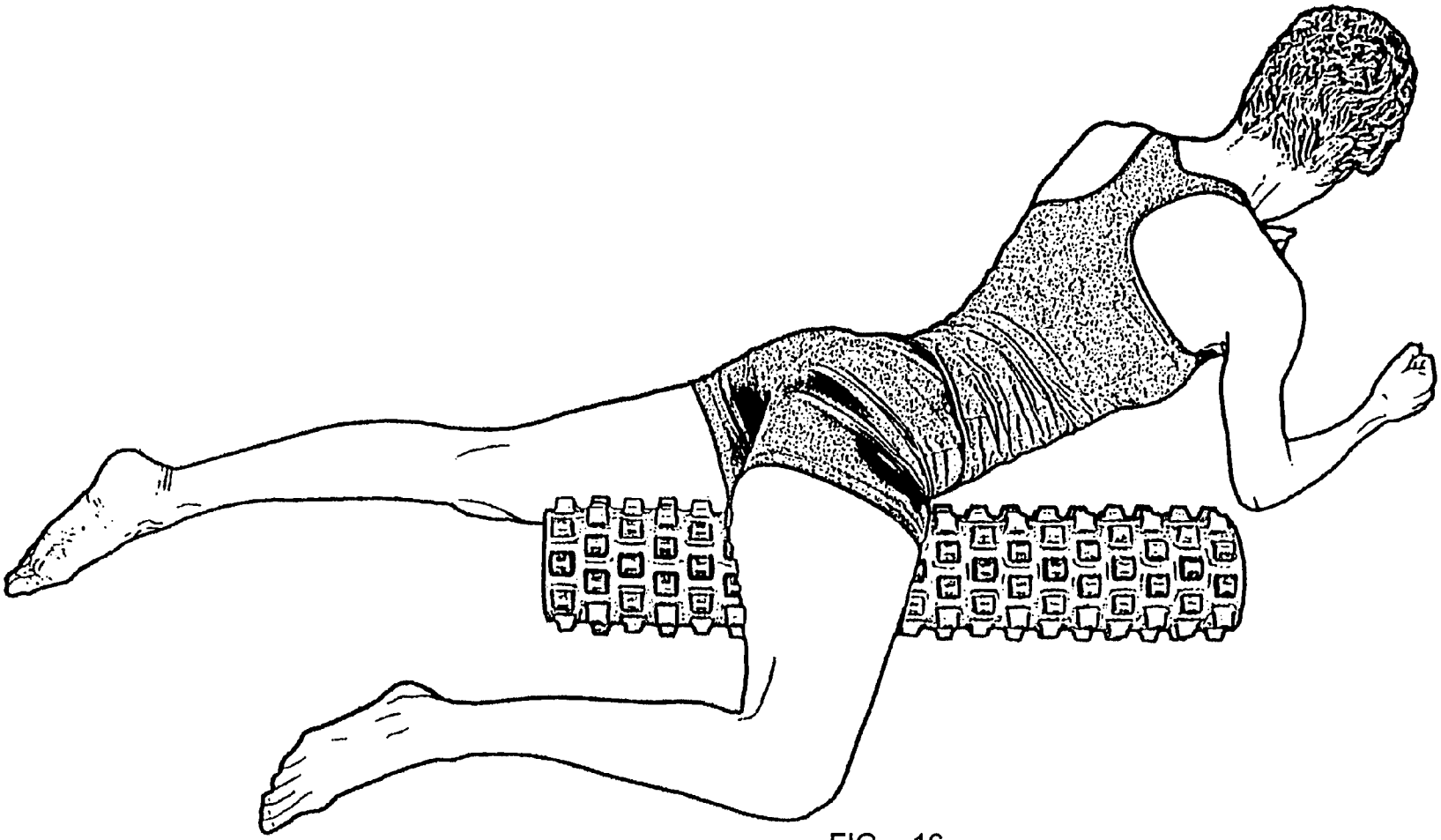

FIGS. 14 to 16 show several representative exercises that may be performed using the roller of the present invention.

The various movements are broadly termed "exercises" but it is to be understood that they are self performed routines to achieve a number of beneficial results including myofascial release, therapy, massage, relaxation and other benefits. The exercises shown are only representative as the roller 10 may be used for numerous other exercises including, but not limited to, myofascial release.

Referring to FIG. 14, a representative upper back exercise is shown using the roller 10. The user is positioned facing upwardly having her upper back and shoulder area positioned against the roller 10 which is generally transverse to the body of the user. The user maintains her abdominal muscles flexed with her head and neck in a neutral position. The user will proceed to slowly roll the roller in the direction of the arrow causing the roller rotation to move from the lower thoracic area to the top of the upper thoracic area. Care should be taken to not roll excessively onto the neck area. To increase the intensity of the exercise, the user may place her arms across her chest and rock to the right and left as rolling movement occurs.

In FIG. 15, the user is shown exercising her calf muscles from the area just below her knees to just above her ankles. The user is shown sitting with her calves on the top of the roller 10 and her heels slightly off the floor. The intensity of the exercise can be increased by crossing one leg over the other at the ankles while continuing to roll the roller 10. For greater intensity, one leg may be placed on top of the roller and then the leg rocked to the left then to the right for deeper penetration by the projections.

FIG. 16 shows an exercise for the adductor muscles. The user is positioned face down supported on her elbows and forearms, keeping her abdominal and back muscles slightly flexed to stabilize her spine. The right knee is on the floor and the groin area of the left leg is against the top of the roller. The user will roll back and forth along the adductor muscles by slowly moving her hips to the left and right. Care should be taken to not apply excessive pressure to the adductor complex origin at the pelvis.

Figure 17:
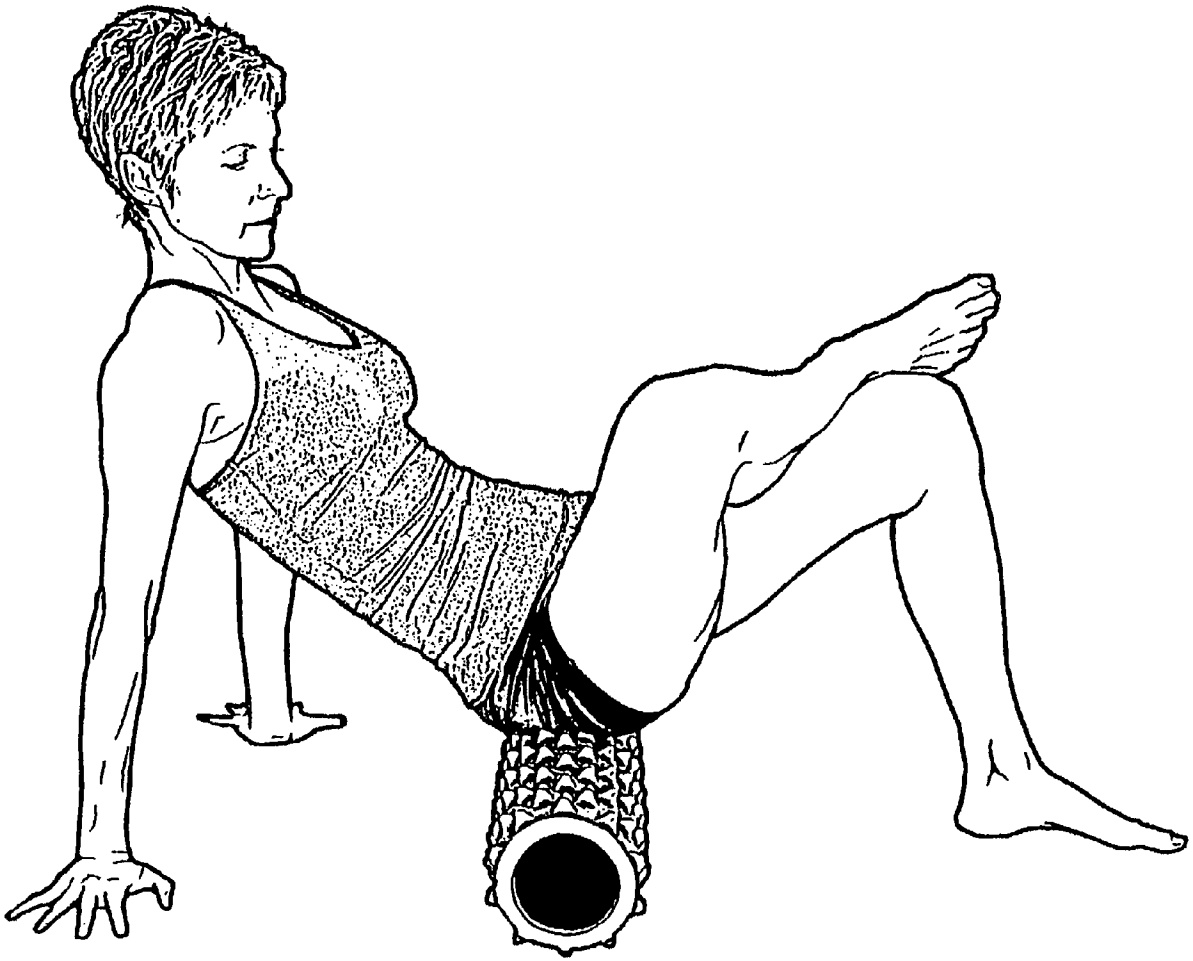

FIG. 17 illustrates another exercise primarily for the gluteal muscles.

The surface of the roller 10 contains a large number of specially arranged projections 20, as described, which are firm but flexible and simulate, to some extent, the thumbs of a massage therapist. As the roller 10 moves or rolls, the projections continuously knead the contours of the body, stretching soft tissue in several directions. The material of the roller and the projections is selected so that the projections are firmer than muscle, but softer than bones so they deflect properly.

The design of the roller 10 allows the user to control the pressure the projections apply to the individual which performs self-massage. The projections are closely spaced-apart, preferably less than 2", so that when performing the various exercises, several of the projections will simultaneously contact the individual's body. With a slight shift of the body, the individual can reduce the area of contact which increases pressure and provides a more deeply penetrating massage action.

The projections 20, as described above in FIGS. 1 to 7, each have a horizontal cross-section as seen in FIG. 7. Accordingly, projections of this shape and of a homogenous elastomeric material have the flex characteristics described above in which the resistance to flex to loads applied in the axial direction is greater than to tangential loads applied. This results in an exercise and massage roller which provides the user a greater range of available exercises and the ability to manage applications at varying levels of intensity. Because the roller projections have a shape which is selected to flex more in one direction, the more common exercises are performed with the roller rolling beneath the body of the user, the projections apply a "wiping" type of massage pressure. If the user "rocks" from side to side toward the ends of the roller 10, as described with reference to FIG. 15, the projections are more resistant to flex, creating a deeper massage effect.

Because the projections are inherently designed to have increased resistance to flex in the axial direction, a projection of a homogenous material in the shape of a cone or cylinder would not provide the required non-symmetrical flexion. However, other shapes such as oval or rectangular would be suitable.

Figure 18:
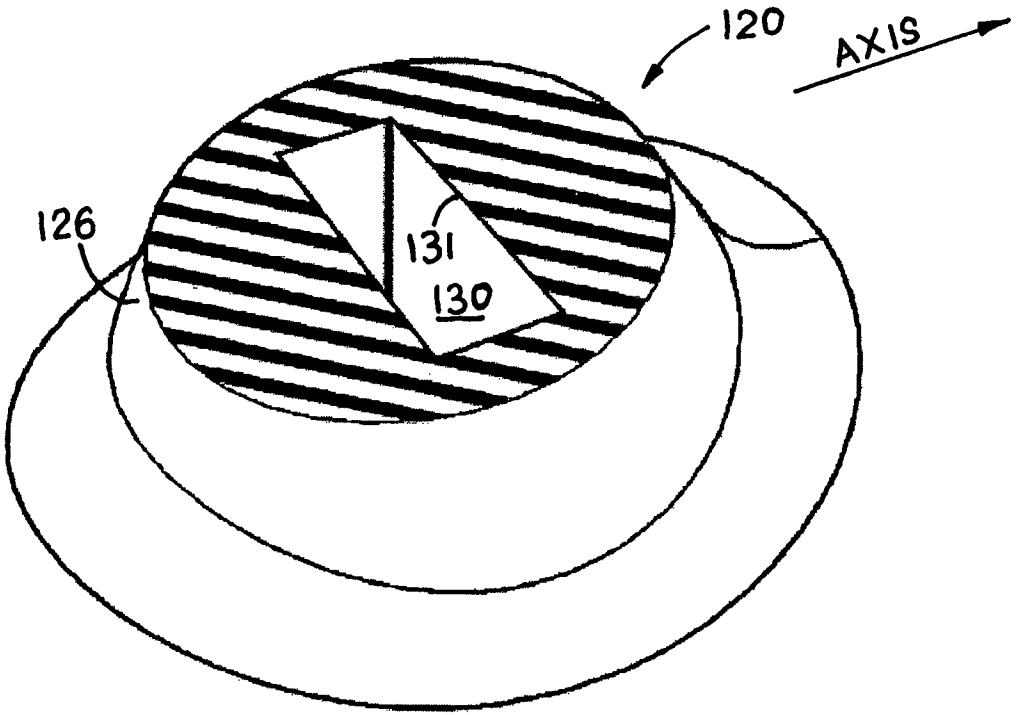
FIG. 18 is a perspective view showing yet another embodiment of a projection on the exercise roller in which an internal area of the projection is relieved to provide the desired bending characteristics.

However, projections of other shapes, such as conical projections, would also be suitable if designed to provide the desired flexure. FIG. 18 shows a cross-section of a conical projection 120 having a body with upwardly converging conical side wall 126 which is truncated at the upper end, not shown. In order to provide the desired flexure characteristics, the projection 120 is fabricated from a homogenous uniform elastomeric material as set forth above, but a section of the interior of the body is relieved at 130. The relieved area is shown as a generally rectangular cutout 130 centrally extending within the body. The cutout is oriented so the longer sidewalls 131 are generally perpendicular to the axis A-A of the roller. The projections 120 are integrally formed as part of the roller and are spaced in bands and rows as previously described. The cutout 130 will alter the symmetry of the shape establishing increased resistance to flex in the axial direction providing the desired characteristics.

Figure 19:
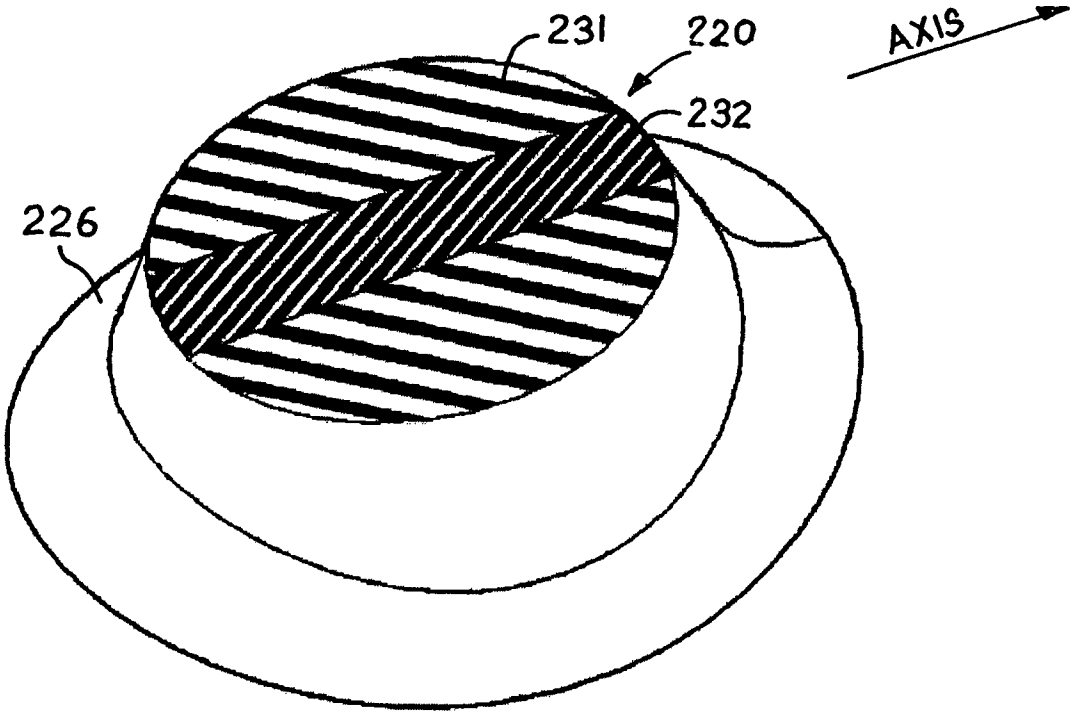
FIG. 19 is yet another perspective view partly broken away showing another embodiment for configuration of the projections extending from the surface of the roller in which the projections are fabricated from several materials having different characteristics.

In FIG. 19 another embodiment of a generally conical projection 220 is shown. The projection 220 has a base with a conical body 226 which extends from the roller body upwardly to a truncated apex, not shown. The material of the body 231 is a different elastomer than that of the insert 232. The insert 132 is a section that extends diametrically within the body and the projection is oriented on the body of the roller to provide greater resistance to flexure to axial loads, as opposed to radial loads. The projections 220 are oriented so the insert 132 is generally parallel to the axis A-A of the roller. These projections 220 are in spaced-apart bands about the roller and arranged in rows, as previously described. The projections are oriented to provide the greatest resistance to flex in the axial direction.

Figure 20:
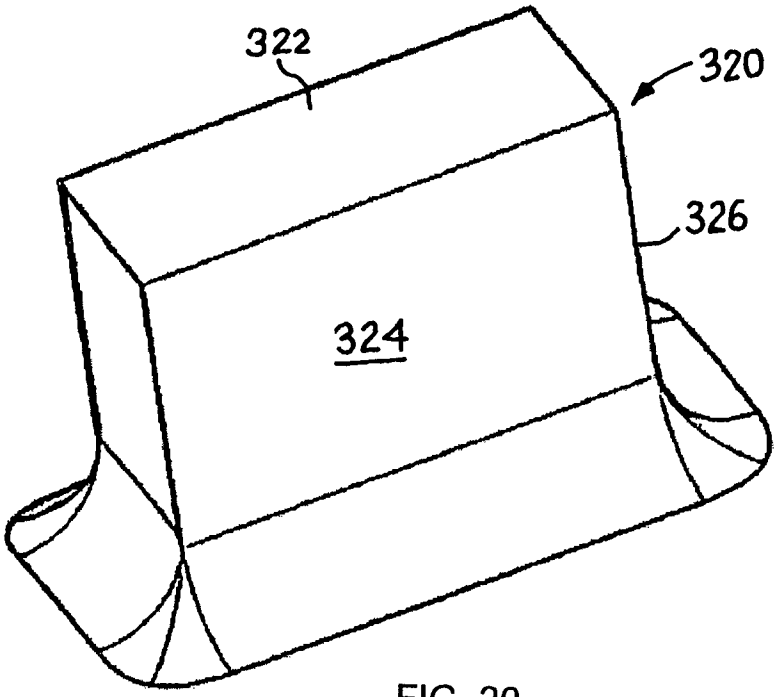
FIGS. 20 and 21 illustrate alternate shapes for the massage projections.
Figure 21:
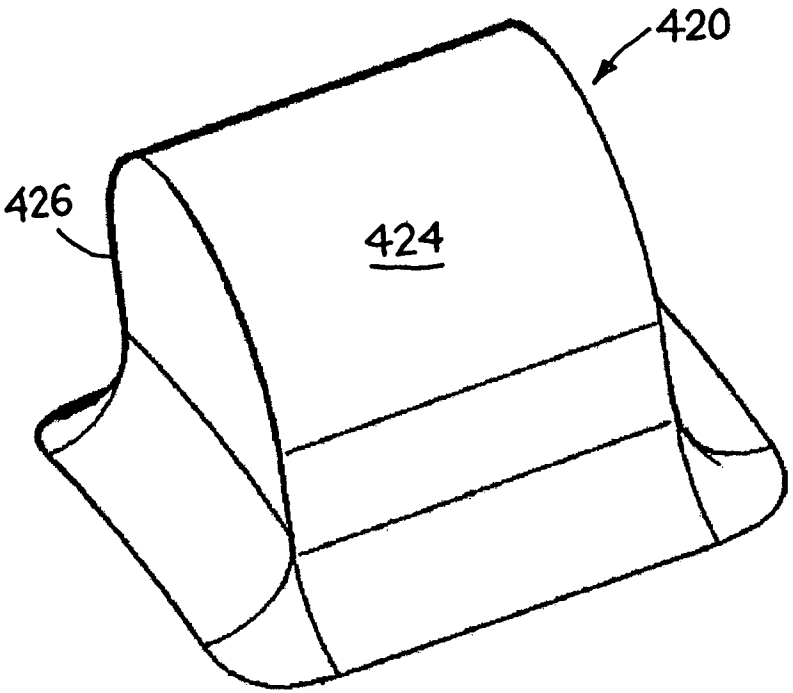

In FIGS. 20 and 21, alternate shapes for the projections are shown generally conforming to that shown in FIGS. 1 to 7. In FIG. 20, the projection 320 is generally rectilinear having top 322, sidewalls 324, and end walls 326 which transition into the body at their lower ends. In FIG. 21, the projection 420 generally has semi-parabolic end walls 426 and a continuously curved sidewall 424.

It will be obvious to those skilled in the art to make various changes, alterations and modifications to the invention described herein. To the extent such changes, alterations and modifications do not depart from the spirit and scope of the appended claims, they are intended to be encompassed therein.

I claim:

1. A massage roller comprising:

a resilient cylindrical body having an axis;

a plurality of axially spaced-apart bands integrally formed with one another, each band comprising a plurality of massage projections aligned circumferentially about the body, each massage projection comprising a base proximate the cylindrical body and separated from a base of an adjacent massage projection by an intermediate space that exposes a portion of the cylindrical body, an arcuate apex extending from the base, a radiused peripheral edge extending around the base of each massage projection, and two opposing side walls sloping closer together from the base towards the arcuate apex at a first angle such that each massage projection has a greater flexure resistance to loads applied axially than to loads applied tangentially, wherein a height:width ratio of each massage projection ranges from 1:1 to 1:2.5 and a height:axial length ratio of each massage projection ranges from 1:1.5 to 1:3.

2. The massage roller of claim 1 wherein each massage projection comprises an axial cross-section which is substantially rectangular.

3. The massage roller of claim 1 wherein each massage projection comprises a radial cross-section which is generally trapezoidal.

4. The massage roller of claim 1 wherein each massage projection further comprises opposing end walls that narrow from the base to the arcuate apex and a curved transition between each end wall and the arcuate apex.

5. The massage roller of claim 4, wherein the projections are an elastomeric material comprised of at least one of a natural rubber or a synthetic rubber.

6. The massage roller of claim 5, wherein the elastomeric material of the massage projection comprises at least one of neoprene, nitrile rubber, silicone, polyurethane, ethylene propylene diene monomer, styrene butadiene, vinyl, butyl, polyethylene, ethylene-vinyl acetate, and polyolefins.

7. The massage roller of claim 6, wherein each massage projection comprises an ethylene-vinyl acetate and polyolefin blend.

8. The massage roller of claim 7, wherein each end wall comprises a rounded upper edge that transitions to the apex and side walls.

9. The massage roller of claim 8, wherein the plurality of bands are staggered such that the massage projections of one circular band of the plurality of circular bands are not axially aligned with the massage projections of an adjacent circular band of the plurality circular bands.

10. The massage roller of claim 9, wherein each massage projection extends about ½ inch from the body and comprises an axial length between approximately ¾ and 1½ inches, and a base width between approximately ½ and 1¼ inches.

11. The massage roller of claim 10, wherein the elastomeric material has a durometer hardness of 30 to 50 Asker C.

12. The massage roller of claim 11, wherein the first angle is approximately 15° and the opposing end walls slope closer together from the base towards the apex at a second angle of approximately 60°, and wherein the massage projections or each circular band are spaced less than 2 inches apart.

13. The massage roller of claim 1 further comprises a solid or hollow core within the cylindrical body.

14. The massage roller of claim 13, wherein the cylindrical body further comprises a lip that holds the solid or hollow core within the cylindrical body.

15. The massage roller of claim 1, further comprising a relieved cutout section within each massage projection.

* * * * *